US008448782B2

(12) United States Patent
Chin

(10) Patent No.: US 8,448,782 B2
(45) Date of Patent: May 28, 2013

(54) DRINK CADDY

(76) Inventor: Anhua Chin, Rancho Cucamonga, CA (US)

( * ) Notice: Subject to any disclaimer, the term of this patent is extended or adjusted under 35 U.S.C. 154(b) by 0 days.

(21) Appl. No.: 12/938,637

(22) Filed: Nov. 3, 2010

(65) Prior Publication Data

US 2012/0085664 A1 Apr. 12, 2012

Related U.S. Application Data

(63) Continuation of application No. 29/376,695, filed on Oct. 11, 2010, now Pat. No. Des. 635,415.

(51) Int. Cl.
*B65D 77/00* (2006.01)

(52) U.S. Cl.
USPC ..... 206/217; 206/223; 206/778

(58) Field of Classification Search
USPC ..... 206/217, 216, 223, 591, 568, 569, 206/224, 261, 242, 349, 533, 315.11, 574, 206/575, 780, 778, 771, 426, 433, 446
See application file for complete search history.

(56) References Cited

U.S. PATENT DOCUMENTS

| | | | | | |
|---|---|---|---|---|---|
| 1,773,663 | A * | 8/1930 | Dickens | 206/544 |
| 2,325,224 | A * | 7/1943 | Bryant | 206/446 |
| 3,119,494 | A * | 1/1964 | Rosenstiel | 206/216 |
| 3,712,462 | A * | 1/1973 | Gabor et al. | 206/217 |
| 3,986,610 | A * | 10/1976 | Hawn | 206/592 |
| 3,998,072 | A * | 12/1976 | Shaw | 62/457.4 |
| 4,681,225 | A * | 7/1987 | Schuster | 206/426 |
| 5,582,293 | A * | 12/1996 | Kay | 206/457 |
| 5,862,937 | A * | 1/1999 | Carrizales et al. | 220/501 |
| 6,053,317 | A * | 4/2000 | Morris et al. | 206/433 |
| 6,213,340 | B1 * | 4/2001 | Gehant | 220/752 |
| 6,244,554 | B1 * | 6/2001 | Baker | 248/312 |
| 6,460,722 | B2 * | 10/2002 | Lee | 220/592.16 |
| D470,725 | S * | 2/2003 | Basara | D7/603 |
| 6,523,738 | B1 * | 2/2003 | Sarne et al. | 229/101 |
| 6,585,127 | B2 * | 7/2003 | Yang | 220/23.86 |
| D509,062 | S * | 9/2005 | Tagliati et al. | D3/277 |
| 7,000,775 | B2 * | 2/2006 | Gelardi et al. | 206/776 |
| 7,882,950 | B2 * | 2/2011 | Nazari | 206/488 |
| 8,033,727 | B2 * | 10/2011 | Gattino | 383/20 |
| 2009/0071856 | A1 * | 3/2009 | Simottel et al. | 206/446 |

* cited by examiner

*Primary Examiner* — J. Gregory Pickett
*Assistant Examiner* — Ernesto Grano
(74) *Attorney, Agent, or Firm* — Clement Cheng

(57) ABSTRACT

A drink caddy has an assembled mode and a deployed mode and includes a lower bucket, a sealed beverage held within the lower bucket, a liner having a liner upper edge and a liner lower edge, a lid connected to the liner upper edge and a lid handle disposed on the lid. The liner is held to the lower bucket at a liner lower edge. The liner separates from the bucket when a user deploys the product in a deployed mode. An intermediate separator can be fitted inside the liner and a pair of glassware retained on the intermediate separator. The sealed beverage can be a bottle of alcoholic beverage. The lower bucket is preferably made of a clear transparent plastic to allow viewing of the bottle.

16 Claims, 6 Drawing Sheets

DRINK CADDY

This application claims priority from U.S. patent Ser. No. 29/376,695 filed Oct. 11, 2010 entitled drink caddy by the same inventor, the disclosure of which is incorporated herein by reference.

FIELD OF THE INVENTION

The present invention is in the field of beverage containers, and more specifically drink caddies.

DISCUSSION OF RELATED ART

Having a bottle of champagne, wine or pop on ice has been a popular celebration and holiday tradition. Typically, an ice bucket is used for housing the sealed beverage so that the beverage can be chilled by the ice. A variety of containers can hold the beverage and ice.

Packaging has been made for a beverage that allows conversion into a convertible package. For example, in Rosenthiel U.S. Pat. No. 3,119,494 issued Jan. 28, 1964, entitled Convertible Package the disclosure of which is incorporated herein by reference, a convertible package shows a package that can open for converting into an ice bucket for a sealed beverage. A variety of cartons have been made to be expendable for receiving ice or other cooling means. In Rusnock U.S. Pat. No. 6,945,450, issued Sep. 20, 2005 entitled Beverage Cooler Carton, the disclosure of which is incorporated herein by reference, the beverage container expands for receiving a volume of ice.

SUMMARY OF THE INVENTION

A drink caddy has an assembled mode and a deployed mode and includes a lower bucket, a sealed beverage held within the lower bucket, a liner having a liner upper edge and a liner lower edge, a lid connected to the liner upper edge and a lid handle disposed on the lid. The liner is held to the lower bucket at a liner lower edge. The liner separates from the bucket when a user deploys the product in a deployed mode. An intermediate separator can be fitted inside the liner and a pair of glassware retained on the intermediate separator. The sealed beverage can be a bottle of alcoholic beverage. The lower bucket is preferably made of a clear transparent plastic to allow viewing of the bottle.

The lower bucket has a pair of bucket handle openings formed in left and right side walls of the lower bucket. The lower bucket may have a bucket slouch sloping downward from a higher portion apex of the lower bucket. The lower bucket may have a handle opening to allow user carrying of the bucket. The lower bucket may have a bottle retainer formed as a depression formed in a bucket base. The lower bucket may have a bottle retainer formed as a low ring wall passing around the lower profile and lower edge base of the bottle. The lower bucket can be a rigid light permeable plastic member such as a polycarbonate.

The strap connects to a strap lid connection at a strap upper end and connects to the lower bucket at a strap lower end. The lid has a flat lid top that has a pair of lid strap openings which provide an opening for a pair of straps to pass through the lid top and connect to the liner on an inside surface of the liner. The pair of straps are adhered to the inside surface of the liner as well as to the outside surface of the liner.

Figure 1:
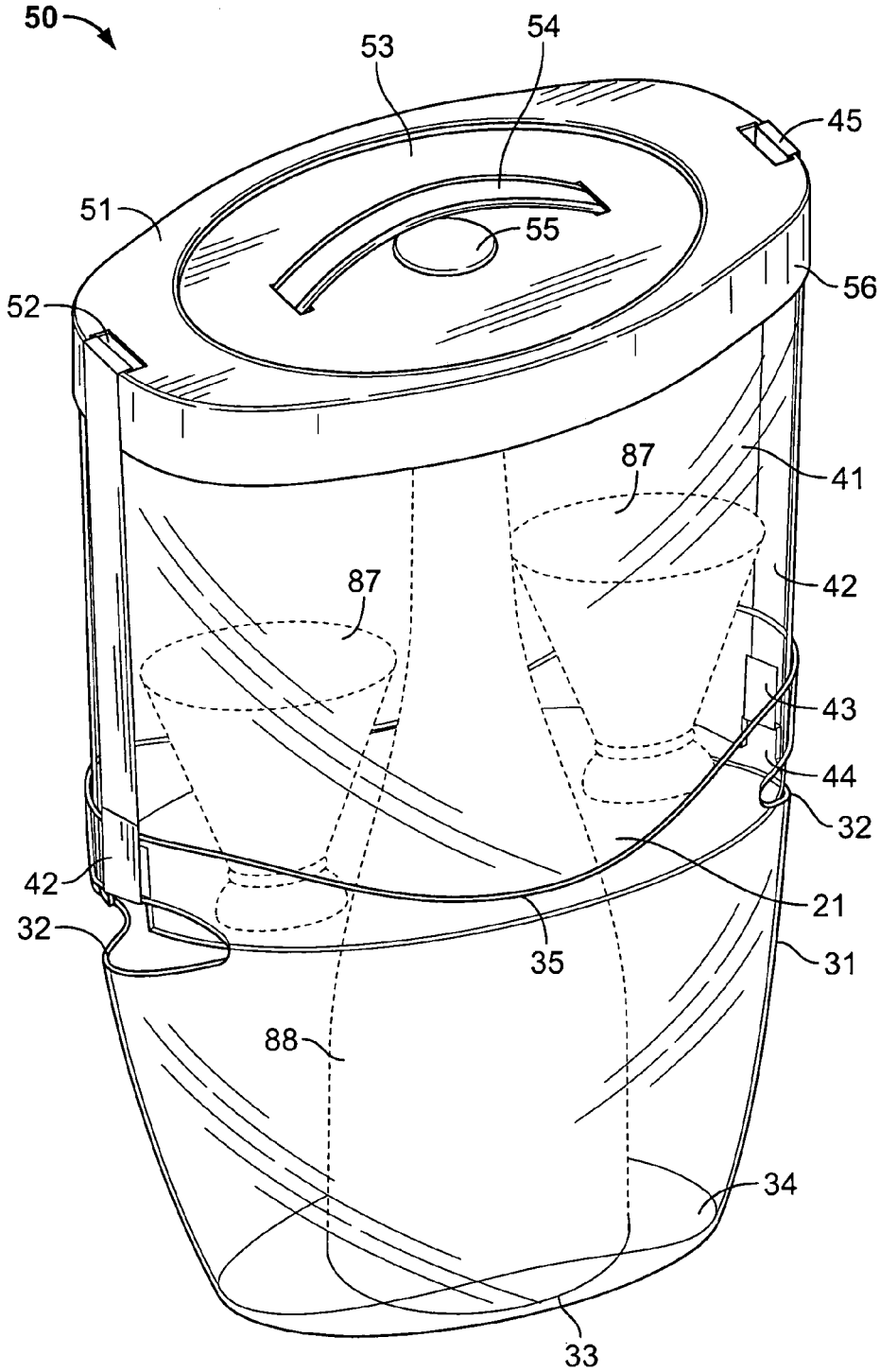
FIG. 1 is a perspective view of the present invention.
Figure 2:
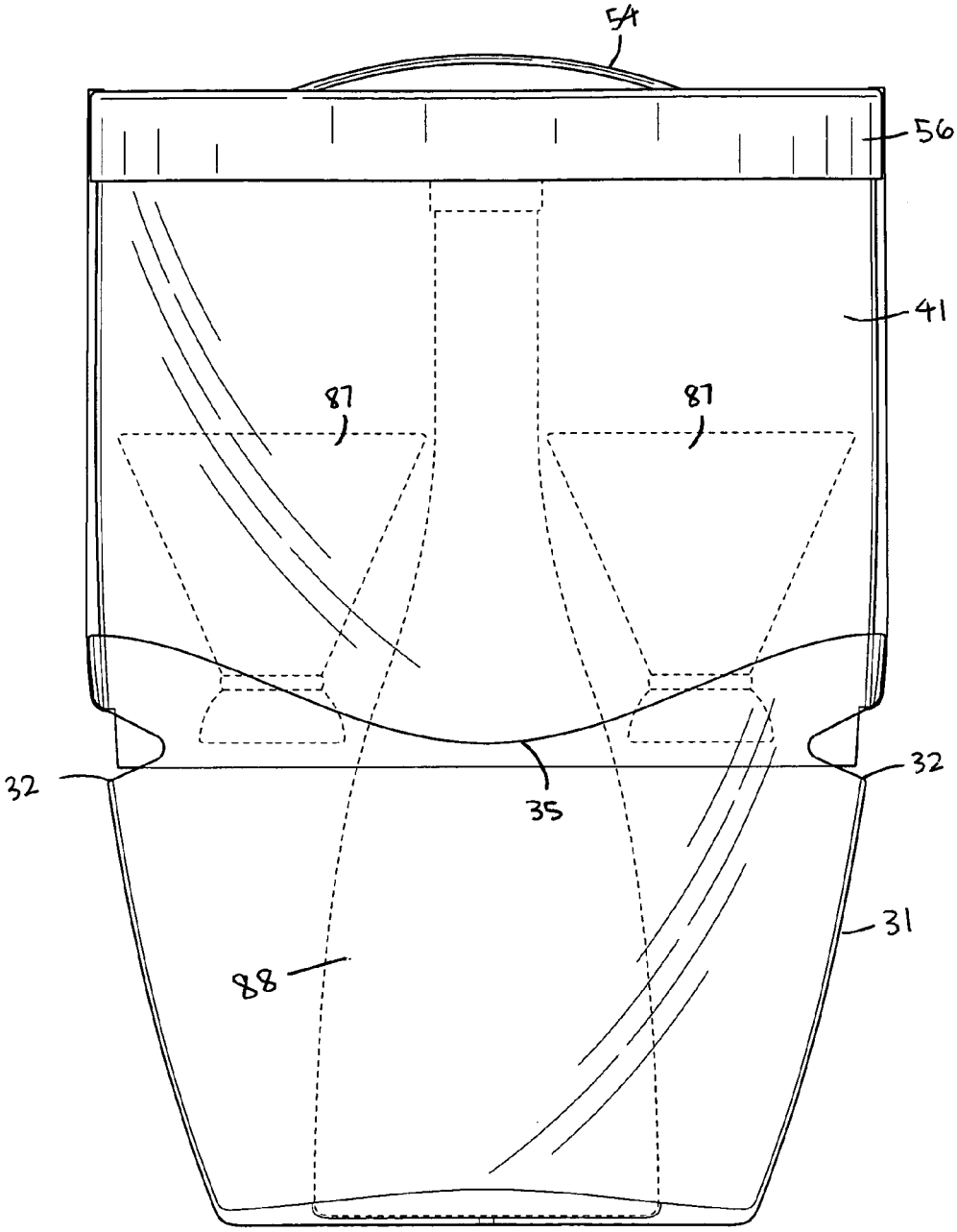
FIG. 2 is a front view of the present invention.
Figure 3:
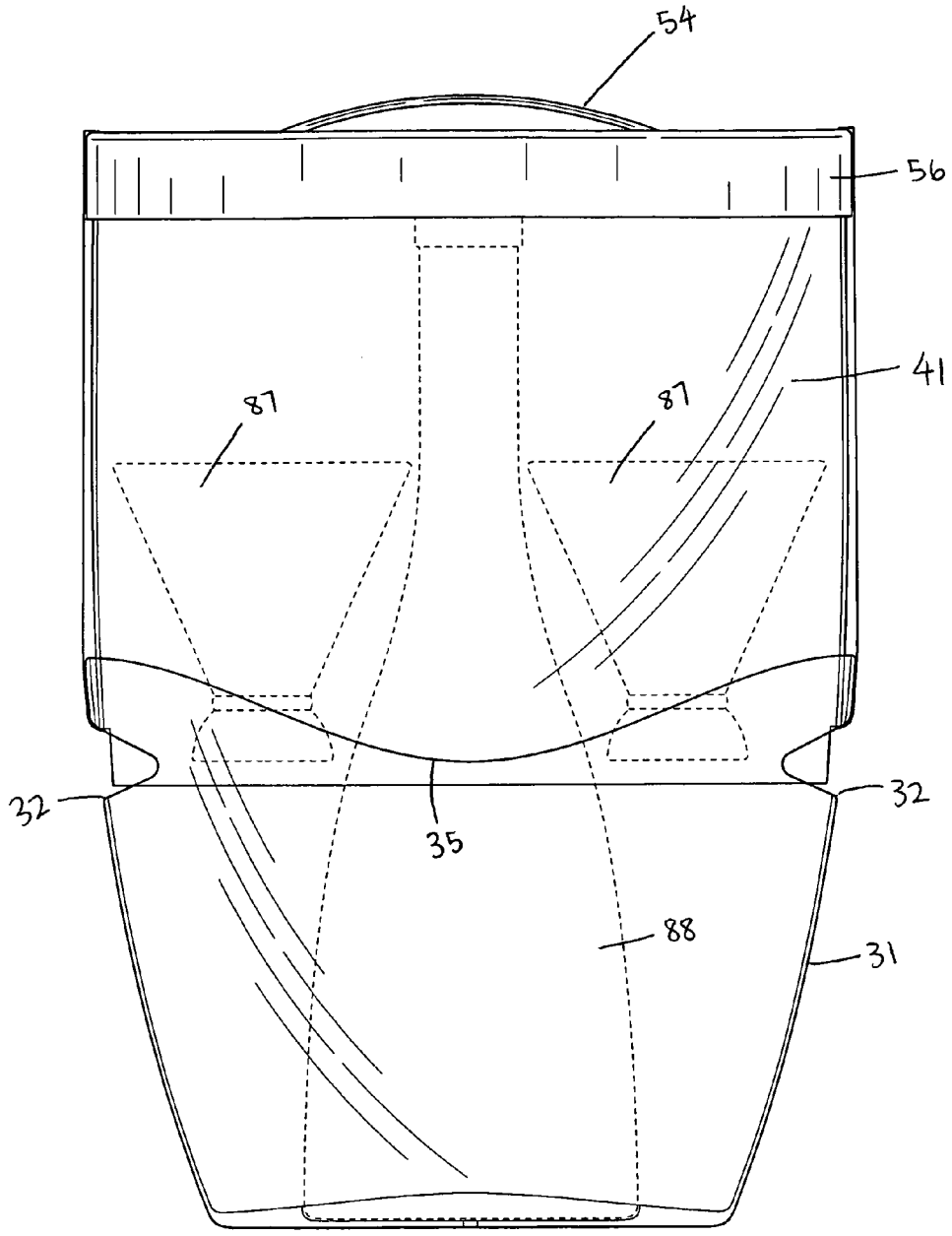
FIG. 3 is a rear view of the present invention.
Figure 4:
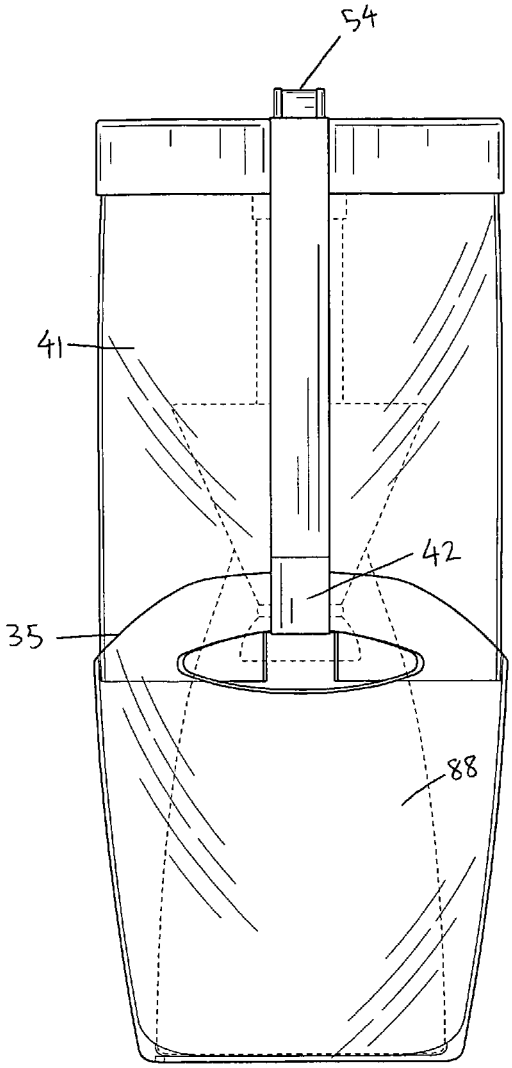
FIG. 4 is a left view of the present invention.
Figure 5:
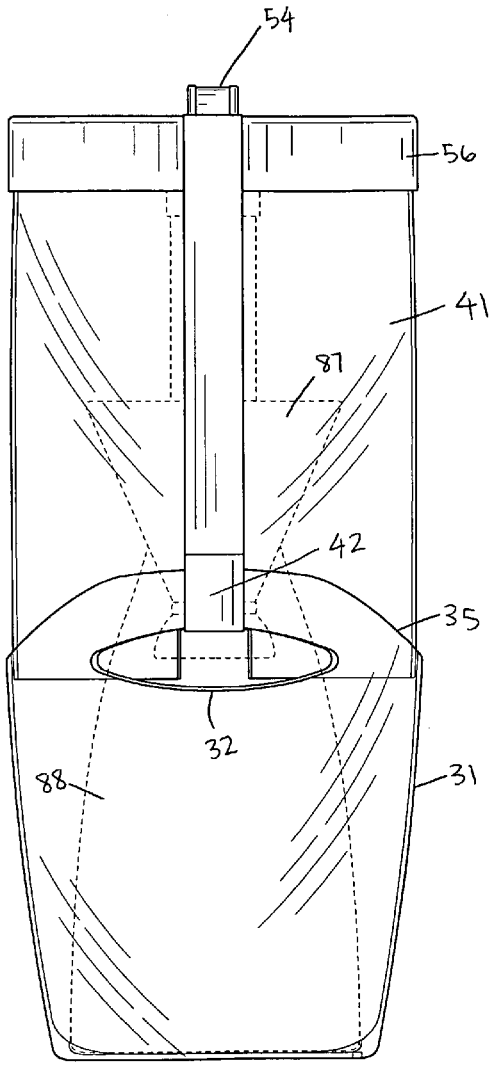
FIG. 5 is a right view of the present invention.
Figure 6:
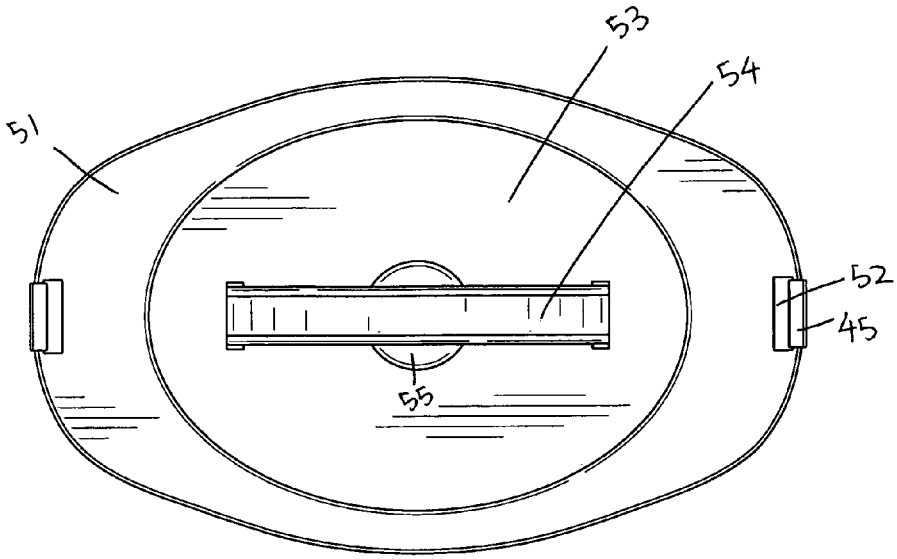
FIG. 6 is a top view of the present invention.
Figure 7:
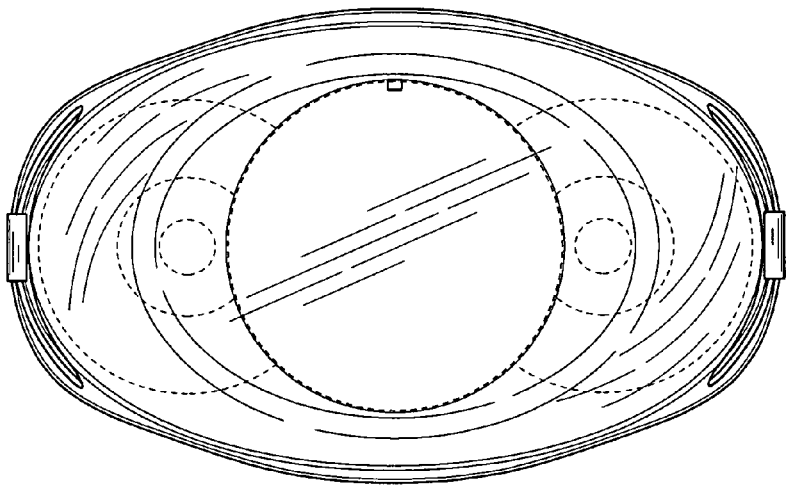
FIG. 7 is a bottom view of the present invention.
Figure 8:
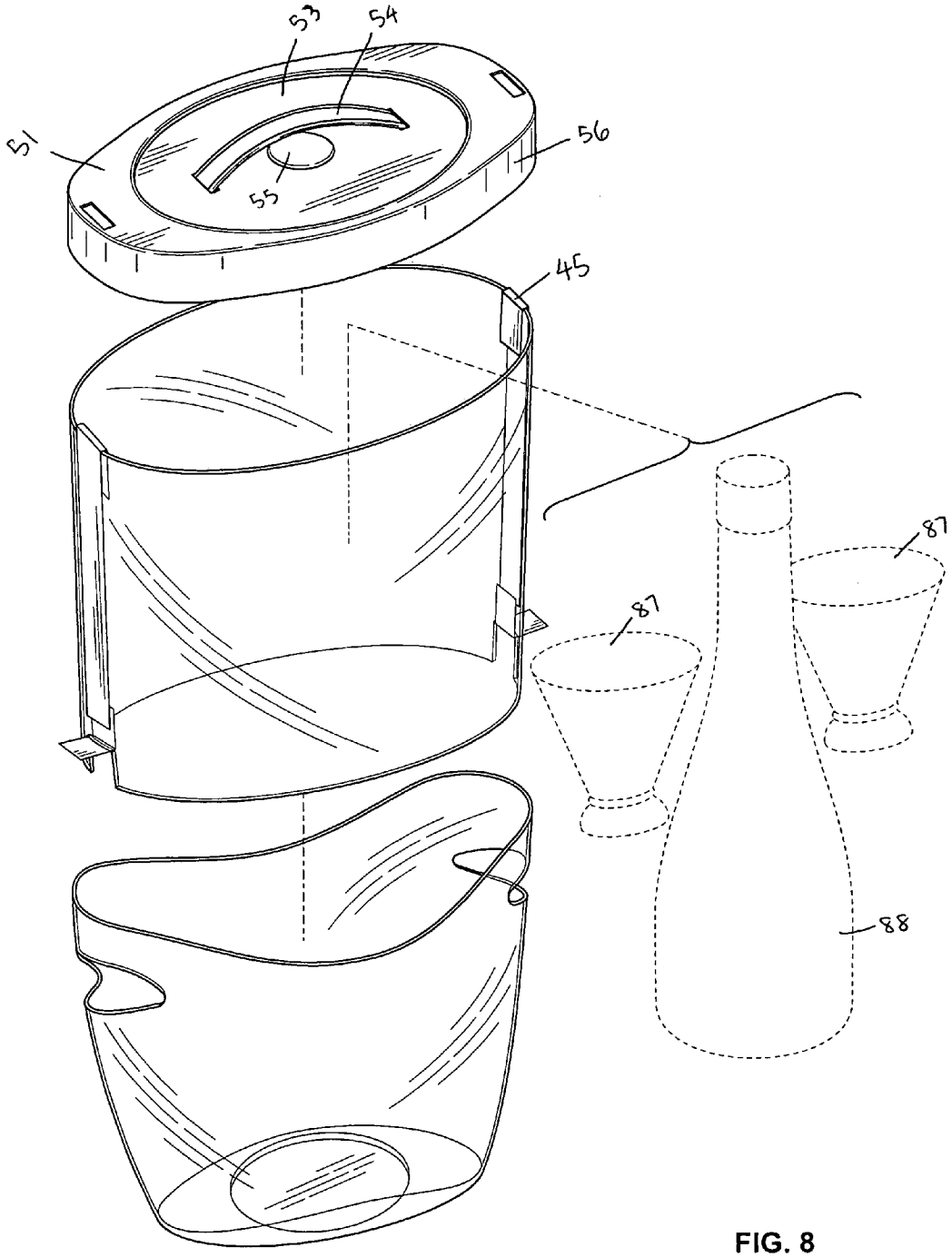
FIG. 8 is an exploded view of the present invention.

The following call a list of elements is a useful guide in understanding the elements of the drawings.

21 Intermediate Separator
31 Lower Bucket
32 Bucket Handle Opening
33 Bottle Retainer
34 Bucket Base
35 Bucket Slouch
41 Liner
42 Strap
43 Strap Fold Connection
44 Bucket Handle
45 Strap Lid Connection
50 Lid
51 Lid Top
52 Lid Strap Opening
53 Lid Depression
54 Lid Handle
55 Lid Bottle Retainer
56 Lid Side Wall
87 Glassware
88 Bottle

DETAILED DESCRIPTION OF THE PREFERRED EMBODIMENT

The present invention is a housing or a container for a beverage, which is a drink caddy that acts as a housing for a bottle 88, or other container and a pair of glassware 87. A lower bucket is loaded with a bottle and a liner is placed over the bucket so that the lower edge of the liner is put into the lower bucket. A pair of straps connects the liner to a lid that is over the top edge of the liner. The lid has a handle for carrying of the entire apparatus. The lower bucket has a pair of ice cavity to the left and right of the sealed beverage.

The lower bucket 31 is preferably made of a clear transparent plastic having a pair of bucket handle openings 32 formed in left and right side walls of the lower bucket 31. The lower bucket also preferably has a bucket slouch 35 sloping downward from a higher portion apex of the lower bucket. The handle opening 32 is preferably oval-shaped to allow user carrying of the bucket.

The lower bucket 31 has a bottle retainer 33 which can be a depression formed in a bucket base 34. The bottle retainer 33 can also be formed as a ring passing around the lower profile and lower edge base of the bottle. The lower bucket is preferably a rigid transparent plastic member or rigid translucent plastic member. The lower bucket separates from the rest of the housing to provide a container for ice to be filled on top of the bottle 88.

The liner 41 separates from the bucket after a user purchases the product and wishes to deploy the product in a deployed mode. The liner 41 is preferably formed of a sheet of plastic that has been screen printed and cut with a pair of notches. In deployed mode, the liner 41 is removed by breaking the connection between the liner and the bucket. The liner 41 is attached to the bucket by a pair of straps 42, and optionally tape. The liner preferably has a pair of notches that may assist in an alignment of the pair of straps. The pair of straps 42 has a strap fold connection 43 that loops underneath the liner at a slot cut out in the liner and connecting the liner with the bucket. The strap fold connection 43 preferably has adhesive that sticks the strap fold connection 43 and the liner and a pair of straps together. The bucket handle 44 can be used for carrying the device in the assembled mode, before a user deploys the housing in a deployed mode.

The strap 42 connects to a strap lid connection 45 at an upper end of the housing. The lid 50 has a flat lid top 51 that has a pair of lid strap openings 52. The pair of lid strap openings 52 provide an opening for the pair of straps 42 to pass through the lid top and connect to the liner on an inside surface of the liner. The pair of straps 42 are preferably adhered to the inside surface of the liner as well as to the outside surface of the liner. The liner is preferably a screen-printed transparent or translucent piece of plastic. The lid has a lid depression 53 disposed in the middle of the lid. The lid depression is optional and preferably allows for a connection of a lid handle 54 to the lid 50. The lid depression may have a lid bottle retainer 55 formed as a protrusion from a surface of the lid depression 53. The lid bottle retainer 55 keeps the bottle from sliding around. The bottle can be secured by sandwiching the bottle between the lid bottle retainer 55 and the bottle retainer 33 on the bucket base 34. Preferably, tension on the pair of straps retains the lid against the liner and the bucket keeping the housing together. When a user wishes to use the product, the user can cut the straps allowing separation of the bucket from the housing.

Depending upon the adhesive used, the user may also be able to peel off the straps without cutting.

The intermediate separator 21 can be formed as a piece of plastic that is transparent and molded to receive a base of a pair of glassware 87. The intermediate separator 21 is preferably formed of a flat sheet of transparent plastic that has been punched and formed. The intermediate separator 21 retains the glassware and suspends it at the level of a bottom edge of the liner 41. The intermediate separator 21 preferably has and a round opening for receiving the bottle 88. A user may dispose of the intermediate separator 21, the liner 41, the strap 42 and the lid 50 as well as the entire lid assembly. The user would keep the bucket with the bottle in the bucket and fill the bucket with ice. After the bottle is chilled, the user can pour the contents of the bottle into the glassware 87. Therefore the housing that the bucket comprises a portion of operates to hold the bottle 88, and the glassware 87.

The invention claimed is:

1. A drink caddy having an assembled mode and a deployed mode comprising:

a. a lower bucket;

b. a sealed beverage held within the lower bucket;

c. a liner having a liner upper edge and a liner lower edge, wherein the liner is held to the lower bucket at a liner lower edge, wherein the liner separates from the bucket when a user deploys the product in a deployed mode;

d. a lid connected to the liner upper edge;

e. a lid handle disposed on the lid;

f. a strap that connects to a strap lid connection at a strap upper end and connects to the lower bucket at a strap lower end; and wherein the lid has a flat lid top that has a pair of lid strap openings which provide an opening for the strap and a second strap to pass through the lid top and connect to the liner on an inside surface of the liner.

2. The drink caddy of claim 1, wherein the pair of straps are adhered to the inside surface of the liner as well as to the outside surface of the liner.

3. The drink caddy of claim 1, wherein the liner is a screen-printed transparent or translucent piece of plastic.

4. The drink caddy of claim 1, wherein the lid has a lid bottle retainer that helps the sealed beverage.

5. The drink caddy of claim 1, further comprising an intermediate separator fitted inside the liner and a pair of glassware retained on the intermediate separator.

6. The drink caddy of claim 1, wherein the sealed beverage is a bottle of alcoholic beverage.

7. The drink caddy of claim 1, wherein the lower bucket is made of a clear transparent plastic.

8. The drink caddy of claim 1, wherein the lower bucket has a pair of bucket handle openings formed in left and right side walls of the lower bucket.

9. The drink caddy of claim 1, wherein the lower bucket has a bucket slouch sloping downward from a higher portion apex of the lower bucket.

10. A drink caddy having an assembled mode and a deployed mode comprising:

a. a lower bucket, wherein the lower bucket has a first bucket handle opening and a second bucket handle opening;

b. a liner having a liner upper edge and a liner lower edge, wherein the liner is held to the lower bucket at a liner lower edge, wherein the liner separates from the bucket when a user deploys the product in a deployed mode;

c. a sealed beverage held within the lower bucket and within the liner;

d. a lid connected to the liner upper edge, wherein the lid includes a lid handle disposed on the lid;

e. a strap that connects to a strap lid connection at a strap upper end and connects to the first bucket handle opening at a strap lower end and a second strap that connects to a second strap lid connection at a second strap upper end and connects to the second bucket handle opening at a second strap lower end;

f. an intermediate separator fitted inside the liner and a pair of glassware retained on the intermediate separator.

11. The drink caddy of claim 10, wherein the lid has a flat lid top that has a pair of lid strap openings which provide an opening for a pair of straps to pass through the lid top and connect to the liner on an inside surface of the liner.

12. The drink caddy of claim 10, wherein the pair of straps are adhered to the inside surface of the liner as well as to the outside surface of the liner.

13. The drink caddy of claim 10, wherein the lower bucket has a bucket slouch sloping downward from a higher portion apex of the lower bucket.

14. The drink caddy of claim 10, wherein the lower bucket has a left handle opening and a right handle opening.

15. The drink caddy of claim 10, wherein the lower bucket is made of a transparent plastic.

16. The drink caddy of claim 10, further comprising an intermediate separator fitted inside the liner and a pair of glassware retained on the intermediate separator.

* * * * *